US005123429A

United States Patent [19]

Case et al.

[11] Patent Number: 5,123,429

[45] Date of Patent: Jun. 23, 1992

[54] SMOKING ARTICLES

[75] Inventors: Paul D. Case; Charles N. Lehuquet, both of Southampton, England

[73] Assignee: British-American Tobacco Co., Ltd., Staines, England

[21] Appl. No.: 401,718

[22] Filed: Sep. 1, 1989

[30] Foreign Application Priority Data

Aug. 30, 1988 [GB] United Kingdom ..... 8820496

[51] Int. Cl.[5] ..... A24D 1/02

[52] U.S. Cl. ..... 131/365

[58] Field of Search ..... 131/359, 369, 365, 358, 131/352, 331, 334

[56] References Cited

U.S. PATENT DOCUMENTS 3,638,660 2/1972 Davis ..... 131/369

3,744,496 7/1973 McCarty et al. ..... 131/365

FOREIGN PATENT DOCUMENTS 0251254 1/1988 European Pat. Off. .

2209269 5/1989 United Kingdom .

*Primary Examiner*—V. Millin

*Attorney, Agent, or Firm*—Charles G. Lamb

[57] ABSTRACT

A cigarette having a wrapper comprising one to fifty percent by weight of calcium sulphate and/or calcium tartrate exhibits reduced sidestream smoke delivery and increased puff number.

8 Claims, No Drawings

SMOKING ARTICLES

The invention the subject of this application relates to cigarettes and similar smoking articles.

It is an object of the subject invention to provide improved low sidestream cigarettes or similar low sidestream smoking articles.

It is a further object of the subject invention to provide in advantageous manner smoking articles of enhanced puff number.

The subject invention provides a smoking article comprising a smoking material rod, which rod comprises smoking material and a paper wrapper circumscribing said smoking material, said wrapper comprising 1 to 50 per cent by weight of combustion modifying compound, said compound being calcium sulphate and/or calcium tartrate.

Preferably, the calcium sulphate and/or calcium tartrate is incorporated in the wrapper paper as a filler substance at the paper making stage. In that it is normal for paper employed as cigarette rod wrapper paper to comprise a filler substance, most commonly calcium carbonate, the calcium sulphate and/or calcium tartrate of wrapper papers of smoking articles according to the subject invention may constitute a proportion of the total filler content, the remaining proportion being, for example, one or more of calcium carbonate, magnesium oxide, magnesium hydroxide, alumina and Attapulgite clay. The proportion of the total filler content accounted for by the calcium sulphate and/or calcium tartrate may approach or be 100 per cent.

Wrapper papers of smoking articles according to the subject invention may have had applied to them, suitably in aqueous solution, one or more burn retardant substances.

The calcium sulphate and/or calcium tartrate of wrappers of smoking articles according to the subject invention is advantageously present at a level of at least about 5 per cent, and more advantageously at least about 7 per cent, by weight. It is also advantageous that the calcium sulphate and/or calcium tartrate level does not exceed about 40 per cent by weight and more advantageous that it does not exceed about 35 per cent by weight.

Calcium sulphate utilised for the purposes of the subject invention may be of a hydrated form, preferably being a dihydrate.

Wrappers of smoking articles according to the subject invention may be of an air permeability in a range of 3 to 200 Coresta units.

By employing the subject invention there may be provided smoking articles which exhibit when smoked under standard machine smoking conditions a reduced production rate of sidestream smoke components. As used herein "standard machine smoking conditions" refers to Coresta standard machine smoking conditions, according to which a 35 $cm^3$ puff of two seconds duration is taken every minute.

The term "production rate of sidestream smoke components" as used herein has reference to the total yield of a sidestream smoke component in smoking a smoking article divided by a value obtained by substracting one from the puff number (PN) of the smoking article, the value (PN-1) being the number of inter-puff smoulder periods.

Smoking articles in accordance with the subject invention should preferably exhibit, when smoked under standard machine smoking conditions, a production rate of sidestream smoke particulate matter, on a water and nicotine free basis, (PMWNF) not exceeding 2.5 mg $min^{-1}$, a production rate of sidestream total nicotine alkaloids (TNA) not exceeding 0.4 mg $min^{-1}$ and a production rate of sidestream carbon monoxide not exceeding 5 mg $min^{-1}$. As will be readily apparent to those skilled in the art, a determinant of the production rate of sidestream TNA is the original nicotine content of the smoking material.

When smoked under standard machine smoking conditions, smoking articles in accordance with the subject invention advantageously provide not less than six puffs and more preferably not less than seven puffs.

By employing the subject invention there may be provided smoking articles which exhibit a greater puff number than do control smoking articles, which control smoking articles comprise conventional and comparable paper wrappers, without there resulting a significant increase in the ratio of mainstream smoke carbon monoxide to PMWNF. This phenomenon is very useful to the cigarette designer since it was observed heretofore that if no compensatory measures were taken, the introduction of a proportion of expanded tobacco into a tobacco blend resulted in a reduced cigarette puff number, whereas if the puff number was restored by using cigarette paper of low air permeability or cigarette paper comprising a burn retardant, the carbon monoxide to particulate matter ratio was significantly increased.

In smoking articles according to the subject invention the smoking material suitably comprises cut leaf tobacco, a portion of which, preferably not less than 20 per cent by weight, may be expanded tobacco. The smoking material may comprise a reconstituted tobacco or a tobacco substitute.

If, as is commonly the case with cigarettes and like smoking articles, a smoking material rod of a smoking article in accordance with the subject invention is of uniform circular cross-section, the circumference of the rod may be, for example, in a range of 12.5 mm to 30 mm.

Smoking articles in accordance with the subject invention may comprise filter or mouthpiece means attached to the smoking material rod at one end thereof.

Smoking articles in accordance with the subject invention may incorporate ventilation means.

In order to further the understanding of the subject invention, examples according thereto will now be described.

EXAMPLE I

Control cigarettes were produced comprising cigarette rods, of a length of 64 mm and a circumference of 24.75 mm, and 20 mm long cellulose acetate filters. The cigarette rods comprised a cut tobacco Virginia blend filler of 80% lamina and 20% stem. The density of the rod filler was 280 mg $cm^{-3}$. The cigarette paper wrapper of the cigarette rods was of an air permeability of 28 Coresta units and a substance of 39 g $m^{-2}$. The cigarette paper contained as filler calcium carbonate at a loading level of 29% by weight. The cigarette paper did not comprise a burn additive.

When smoked under standard machine smoking conditions the puff number of these control cigarettes was determined to be 9.1. The static burn rate of the control cigarettes was determined to be 4 mm $min^{-1}$.

Cigarettes according to the subject invention ("inventive cigarettes") were produced. The inventive cigarettes were the same as the control cigarettes in all particulars excepting that the cigarette paper wrappers of the inventive cigarettes were of an air permeability of 19 Coresta units, a basis weight of 39 g $m^{-2}$ and contained as filler 28% by weight of calcium sulphate (grade SABXO supplied by Lambert), no other filler substance being present and no burn additives being present.

When smoked under standard machine smoking conditions the inventive cigarettes were found to have a puff number of 12.5. The static burn rate of the inventive cigarettes was determined to be 2.45 mm $min^{-1}$.

Total sidestream yields and production rates of PMWNF, TNA and CO for the control and the inventive cigarettes when smoked under standard machine smoking conditions are given in the table below. As may be seen from the table, for each of the sidestream smoke components featured, the inventive cigarettes exhibited a lower total yield and a lower production rate than did the control cigarettes. The production rates of sidestream PMWNF, TNA and CO for the inventive cigarettes are, in fact, reduced by 40%, 44% and 40% respectively. This means that if the length of the cigarette rods of the inventive cigarettes was reduced to a length such that the puff number of the inventive cigarettes was reduced to 9.1, i.e. to that of the control cigarettes, the total sidestream yields of PMWNF, TNA and CO of the inventive cigarettes would be reduced by 40%, 44% and 40% respectively, or perhaps even more, compared with the control cigarettes.

| | | PMWNF | TNA | CO |
|---|---|---|---|---|
| Control | Sidestream Delivery (mg) | 29.1 | 5.13 | 63.9 |
| | Production Rate (mg $min^{-1}$) | 3.59 | 0.63 | 7.87 |
| Inventive | Sidestream Delivery (mg) | 26.9 | 4.41 | 59.1 |
| | Production Rate (mg $min^{-1}$) | 2.15 | 0.35 | 4.72 |

EXAMPLE II

The paper wrappers of control and inventive cigarettes had characteristics as follows:

| | Basis Weight gsm | Filler | Filler Level % | Supplier | Grade |
|---|---|---|---|---|---|
| Control | 39 | $CaCO_3$ | 29 | Solvay | 90A |
| Inventive | 39 | $CaSO_4$ | 28 | Lambert | SABXO |

The permeabilities of the paper wrappers of control and inventive cigarettes were 28 and 20 Coresta units (C.U.) respectively.

Smoking of the cigarettes under standard machine smoking conditions yielded the following results:

| | Puff Number | CO:PMWNF Ratio |
|---|---|---|
| Control | 9.1 | 1.18 |
| Inventive | 12.3 | 1.21 |

EXAMPLE III

The paper wrappers of control and inventive cigarettes had characteristics as set forth in the table on the following page.

| | Basis Weight gsm | Filler | Filler Level % | Supplier | Grade | Permeability C.U. |
|---|---|---|---|---|---|---|
| Control | 33 | $CaCO_3$ | 34 | Solvay | 90A | 46 |
| Inventive 1 | 33 | $CaSO_4$ | 34 | Lambert | DH 15 | 38 |
| Inventive 2 | 33 | $CaSO_4$ | 32 | Arnaud | 95GE | 35 |
| Inventive 3 | 33 | $CaSO_4$ | 30 | Joud | Albiclay | 43 |
| Inventive 4 | 33 | $CaSO_4$ | 34 | Lambert | GM 15 | 40 |
| Inventive 5 | 33 | $CaSO_3$ | 16.5 | Solvay | 90A | 44 |
| | | $CaSO_4$ | 12.4 | Lambert | DH 15 | |
| Inventive 6 | 33 | $CaSO_3$ | 18.0 | Solvay | 90A | 34 |
| | | $CaSO_4$ | 15.0 | Arnaud | 95 GE | |
| Inventive 7 | 33 | $CaSO_3$ | 17.0 | Solvay | 90A | 44 |
| | | $CaSO_4$ | 13.9 | Joud | Albiclay | |

For inventive cigarettes 1, 2, 4, 5 and 6 the calcium sulphate was in dihydrate form.

Smoking of the cigarettes under standard machine smoking conditions yielded the following results:

| | Puff Number | CO:PMWNF Ratio |
|---|---|---|
| Control | 9.0 | 1.05 |
| Inventive 1 | 10.5 | 1.06 |
| Inventive 2 | 10.5 | 1.05 |
| Inventive 3 | 9.5 | 1.07 |
| Inventive 4 | 9.8 | 1.03 |
| Inventive 5 | 9.9 | 0.98 |
| Inventive 6 | 10.2 | 0.99 |
| Inventive 7 | 10.0 | 1.06 |

EXAMPLE IV

The paper wrappers of control and inventive cigarettes had characteristics as follows:

| | Basis Weight gsm | Filler | Filler Level % | Supplier | Grade |
|---|---|---|---|---|---|
| Control | 41.0 | $CaCO_3$ | 31.5 | — | — |
| Inventive | 40.2 | $CaCO_3$ | 10.0 | — | — |
| | | $CaSO_4$ | 20.8 | Joud | Albiclay |

The permeabilities of the paper wrappers of control and inventive cigarettes were 11 and 13 C.U. respectively.

Smoking of the cigarettes under standard machine smoking conditions yielded the following results:

| | Puff Number | CO:PMWNF Ratio |
|---|---|---|
| Control | 8.9 | 1.29 |
| Inventive | 9.3 | 1.27 |

The control and inventive cigarettes of Examples II–IV comprised cigarette rods, of a length of 64 mm and a circumference of 24.75 mm, and 20 mm long cellulose acetate filters, which filters were identical for all of the cigarettes.

The cigarette rods of the control and inventive cigarettes of Examples II and III comprised a cut tobacco filler comprised of 80% lamina and 20% stem by weight.

The cigarette rods of the control and inventive cigarettes of Example IV comprised a cut tobacco filler comprised of 16% DIET-expanded lamina, 64% non-expanded lamina and 20% stem by weight.

From the results set forth in Examples II–IV it is to be observed that by use of cigarettes in accordance with the present invention it is possible to provide for an enhanced puff number without there resulting unacceptable increases in the mainstream CO to mainstream PMWNF ratio.

EXAMPLE V

Cigarettes of four types were made, all of the cigarettes being of the dimensional format mentioned above in regard to the cigarettes of Examples II–IV. The four types of cigarettes comprised paper wrappers and tobacco fillers as noted below:

Cigarette 1

Paper wrapper as per the control cigarette of Example II.

Filler wholly of non-expanded cut tobacco.

Cigarette 2

Paper wrapper as per the control cigarettes of Example II.

Cut tobacco filler comprising 80% by weight of DIET-expanded tobacco.

Cigarette 3

Paper as per the inventive cigarettes of Example II.

Filler wholly of non-expanded cut tobacco.

Cigarette 4

Paper as per the inventive cigarettes of Example II.

Cut tobacco filler comprising 80% by weight of DIET-expanded tobacco.

Smoking of cigarettes 1–4 under standard machine smoking conditions yielded results as follows in respect of total deliveries of sidestream smoke components and of puff number.

| | PMWNF | TNA | CO | Puff Number |
|---|---|---|---|---|
| Cigarette 1 | 29.1 | 5.13 | 63.9 | 9.9 |
| Cigarette 2 | 24.1 | 3.25 | 37.1 | 7.9 |
| Cigarette 3 | 26.9 | 4.41 | 59.1 | 12.9 |
| Cigarette 4 (predicted) | 22.8 | 2.80 | 34.3 | |
| Cigarette 4 (actual) | 17.7 | 2.48 | 28.3 | 9.9 |

From these results it is to be observed that by use of cigarettes which are in accordance with the subject invention and which contain expanded tobacco it is possible to provide for sidestream smoke components yields which are reduced to values which are lower than would be expected on a directly proportional basis, whilst maintaining puff number.

EXAMPLE VI

In this example the control cigarettes were the same control cigarettes as used in Example III.

Inventive cigarettes were of the dimensional format mentioned above in regard to the cigarettes of Examples II–IV.

The paper wrappers of the inventive cigarettes had characteristics as follows:

| | |
|---|---|
| Basis Weight (gsm) | 33 |
| Filler | Calcium tartrate |
| Filler level (%) | 26.3 |
| Supplier of filler | Lohmann |
| Permeability (C.U.) | 50 |

Upon smoking the inventive cigarettes under standard machine smoking conditions it was found that the inventive cigarettes exhibited a puff number of 11.8 and a mainstream CO to mainstream PMWNF ratio of 1.08.

EXAMPLE VII

In this example too the control cigarettes were the same control cigarettes as used in Example III.

Inventive cigarettes were of the dimensional format mentioned above in regard to the cigarettes of Examples II–IV.

The paper wrappers of the inventive cigarettes had characteristics as follows:

| | |
|---|---|
| Basis Weight (gsm) | 33 |
| Filler | Calcium tartrate plus Calcium carbonate |
| Filler level (%) | 12.2 (tartrate)<br>14.6 (carbonate) |
| Permeability (C.U.) | 40 |

The calcium tartrate was supplied by Lohmann.

Upon smoking the inventive cigarettes under standard machine conditions it was found that the inventive cigarettes exhibited a puff number of 10.3 and a mainstream CO to mainstream PMWNF ratio of 0.95.

What is claimed is:

1. A smoking article comprising a smoking material rod, which rod comprises tobacco and a paper wrapper circumscribing said rod, said wrapping comprising 1 to 50 per cent by weight of combustion modifying compound, said compound being calcium sulphate and calcium tartrate said amount increasing the puff number in said smoking article.

2. A smoking article according to claim 1, wherein the total filler content of said wrapper does not exceed 50 per cent by weight.

3. A smoking article according to claim 1 wherein said wrapper comprises not less than 5 per cent by weight of said compound.

4. A smoking article according to claim 3, wherein said wrapper comprises not less than 7 per cent by weight of said compound.

5. A smoking article according to any one of claim 1 wherein said wrapper comprises not more than about 40 per cent by weight of said compound.

6. A smoking article according to claim 5, wherein said wrapper comprises not more than about 35 per cent by weight of said compound.

7. A smoking article according to claim 1 wherein said wrapper comprises calcium carbonate.

8. A smoking article according to claim 1, wherein said smoking material comprises expanded tobacco.

* * * * *